United States Patent [19]

Barla

[11] Patent Number: 4,914,998

[45] Date of Patent: Apr. 10, 1990

[54] SECURITY DOCUMENT PROCESSOR

[76] Inventor: John R. Barla, 19715 Parkside, St. Clair Shores, Mich. 48080

[21] Appl. No.: 231,460

[22] Filed: Aug. 12, 1988

[51] Int. Cl.[4] ..... B02C 4/02

[52] U.S. Cl. ..... 83/165; 83/122; 83/343; 83/365; 83/521; 83/923

[58] Field of Search ..... 241/169.1, 236; 83/165, 83/343, 365, 923, 122, 520, 521

[56] References Cited

U.S. PATENT DOCUMENTS

| | | | |
|---|---|---|---|
| 1,931,468 | 10/1933 | Bergholtz | 83/122 |
| 2,131,601 | 9/1938 | Taub | 83/520 |
| 2,959,997 | 11/1960 | Huck | 83/165 X |
| 3,104,688 | 9/1963 | Bretthauer | 83/520 X |
| 3,143,908 | 8/1964 | Schildt et al. | 83/365 X |
| 4,009,838 | 3/1977 | Tashman | 241/236 X |
| 4,257,565 | 3/1981 | Hatanaka | 241/236 X |
| 4,529,134 | 7/1985 | Williams | 241/30 |
| 4,545,537 | 10/1985 | Kimura et al. | 241/236 X |
| 4,560,110 | 12/1985 | Burda | 241/36 |
| 4,560,112 | 12/1985 | Rouse et al. | 241/236 |
| 4,562,971 | 1/1986 | Schwelling | 241/236 |
| 4,565,330 | 1/1986 | Katoh | 241/236 |
| 4,591,104 | 5/1986 | Bounds | 241/169.1 |
| 4,615,490 | 10/1986 | Goldhammer | 241/36 |
| 4,619,407 | 10/1986 | Goldhammer | 241/36 |
| 4,717,085 | 1/1988 | Crane | 241/236 |
| 4,753,431 | 1/1988 | Fujimoto et al. | 271/301 |
| 4,754,933 | 7/1988 | Leuthold et al. | 241/236 X |

*Primary Examiner*—Frank T. Yost
*Assistant Examiner*—Rinaldi Rada
*Attorney, Agent, or Firm*—J. Gordon Lewis

[57] ABSTRACT

A device for obliterating information discernible on disposable carbons from multi-part forms used in credit card transactions includes a processor contained within a housing defining a document receiving slot in an optically transparent viewing window, wherein a document inserted into the slot is fed to the processing region to obliterate certain confidential information on the carbons and to discharge the document into a guide slot in a fixed orientation adjacent the viewing window hereby the credit customer can visually verity that information obliteration has taken place without having to touch the carbon set.

19 Claims, 1 Drawing Sheet

SECURITY DOCUMENT PROCESSOR

TECHNICAL FIELD

The present invention relates to an apparatus for obliterating confidential information contained on certain security documents and more particularly to the obliteration of such information imprinted on the disposable portion of multi-part business forms typically used in consumer sales.

BACKGROUND OF THE INVENTION

The wide spread use of embossed credit cards has generated an increased need in maintaining secrecy and security of confidential financial business information. Particularly, the use of multi-part business forms at retail point of sale transactions has created a particular problem relating to the disposal of carbon transfer sheets which are typically interleaved between the multi-part form pages. During a retail credit transaction, an embossed personal credit card is presented to the retailer who places it within an imprinting machine which transfers account and transaction information to the business form. When the transaction is complete, the retailer tears the form apart, discarding the set of carbons, providing the customer with one copy and retaining one or more store copies. Although the various form parts retained by the customer and retailer are afforded secure treatment, the carbons themselves, containing the same confidential information are routinely discarded in a waste basket and are thus accessible to unauthorized third parties.

Because of the widespread increase in consumer credit fraud, consumers are becoming aware of the problem and insist on the carbons being torn by the retailer prior to being discarded or, alternatively, take the carbons with them. Unfortunately, both of these solutions have shortcomings. Typically, a carbon set is only torn in half or into four segments which can be readily pieced together. Although the consumer's retention of the carbon sheets will ensure against their unauthorized use, such sheets are inherently dirty and can easily transfer stains to clothing, hand bags and the like.

Although paper shredders have long been in use, they are generally not application specific and are sized large enough to receive full size sheets of paper (typically 8½" by 11"). Such shredders include oversized motor drives to avoid jamming even when a large number of sheets are simultaneously fed into the shredder. It has been found that commercially available shredders are wholly unsuitable for disposing of the thin tissue like material of carbon sets. Additionally, because carbon sets are relatively small, the use of a large general purpose shredder will not ensure that its orientation is maintained for uniform shredding. In fact, tissue like carbons can pass unscathed through some larger type shredders. Because of their size and cost, conventional shredders are not suitable for use at retail point of sale. Furthermore, customers are left with an uneasy feeling inasmuch as conventional shredders do not provide visual verification that the shredding process was successfully completed. Another disadvantage of existing shredders is that they can be extremely noisy and hazardous to use by untrained personnel.

A still further disadvantage of prior art shredders such as that disclosed in U.S. Pat. No. 4,717,085 to Crane entitled "Document Shredding Machines", is that the shredding is accomplished by a series of roller knives which cut the entire document into a plurality of strips which are simultaneously discharged into and unsecured waste container. Although difficult, enough strip waste pieces can be reassembled by an unscrupulous individual to extract valuable information inasmuch as the bins are not typically provided with locking devices. Furthermore, key information such as an account number is typically located on a narrow field on the form that can survive the shredding intact.

BRIEF DESCRIPTION OF THE INVENTION

The present invention provides a new and improved apparatus for the obliteration of confidential information imprinted on a security document in an effective, unobtrusive and inexpensive manner while providing visual verification to a retail customer that the obliteration process has taken place. Furthermore, the apparatus of the present invention is extremely simple, safe and self explanatory in its use and the obliterated documents are retained within a secured area within the apparatus until authorized access is gained.

The apparatus of the present invention comprises housing means defining a document receiving slot and an optically transparent viewing window as well as processing means operative to engage a document inserted into the slot, to feed the document through a processing region within the housing to obliterate selected confidential information imprinted on the document as said document passes through the region and, finally, to discharge the document into a guide chute in a fixed orientation adjacent the viewing window whereby the apparatus operator can visually verify that the information obliteration has in fact taken place prior to disposal of the document. This arrangement has the advantage of ensuring neat, orderly and verified destruction and disposal of security documents.

According to an aspect of the invention, a locked refuse drawer is disposed within the lower portion of the housing which includes means to guide the obliterated document into the drawer in a predetermined orientation for secured storage. This arrangement provides for compact construction, security and avoids the need for a separate refuse container. Alternatively, provision can be made for placing the apparatus housing on a stanchion over a suitable conventional waste receptacle or alternatively, directly mounting the apparatus on the point of sale embossing mechanism itself.

According to another aspect of the invention, the document processor includes two tangentialty abutting rollers and means operative to drive the rollers counter rotationally to engage a document inserted into the slot, to continuously feed the document between the rollers and to discharge the document into the guide chute in fixed orientation adjacent to the viewing window. The rollers carry an array of chisels and chisel receiving recesses disposed for mutual complimentary engagement to punch a predetermined pattern of holes in the document to obliterate selected confidential information imprinted thereon. This arrangement provides a simple, reliable mechanism for obliterating fields of information at known locations on a carbon set without the need to render the entire set into separate strips.

According to another aspect of the invention, the chisel receiving recesses include radially extending passageways connecting the outer circumferential surface of the roller with an interior cavity whereby chaff punched from the document is progressively radially inwardly directed and discharged into the cavity for intermixing with chaff from earlier obliterated documents. This arrangement has the advantage of intermixing chaff from multiple documents to substantially increase the difficulty in fraudulent reconstruction.

According to another aspect of the invention, the radially extending passageways of the roller have characteristic varying lengths to effect a time delay discharge of the chaff into the interior cavity. This arrangement has the advantage of further intermixing the chaff from multiple carbon sets thereby enhancing security.

According to another aspect of the invention, the apparatus includes a document inlet guide disposed intermediate said document receiving slot and document processor and a drive actuator circuit including at least one light source and at least one photo sensitive receiver laterally disposed adjacent to said inlet guide to sense the presence of an opaque document within the inlet guide and energize the drive means as a function thereof. This arrangement has the advantage of providing an "automatic" turn on function whenever the leading edge of the document is placed within the receiving slot and the turn off function when the trailing edge of the document exits the slot.

According to another aspect of the invention, the roller interior cavity is generally cylindrically shaped having a closed end of minor radially diameter and an open end of major diameter, the open end communicating with a shaft discharge chute communicating with a waste receptacle. This arrangement has the advantage whereby upon rotation of the rollers, chaff contained within the interior cavity is urged axially toward the discharge chute.

According to still another aspect of the invention, a second optically transparent viewing window is provided in a front face of the housing exposing the interior of the shaft discharge chute. Furthermore, the document processor is further operative to indefinitely suspend an obliterated document within the guide chute until another security document is placed within the document receiving slot. These two features have the advantage of allowing the customer to carefully inspect the obliterated document and simultaneously view falling chaff. This arrangement further has the arrangement of preventing chaff from binding or interfering with the passage of the security document.

These and other features and advantages of the present invention will become apparent upon reading the following specification, which, along with the patent drawings, describes and discloses a preferred embodiment of the invention in detail.

A detailed description of the embodiment of the invention makes reference to the accompanying drawings.

DETAILED DESCRIPTION OF THE PREFERRED EMBODIMENT OF THE INVENTION

Figure 1:
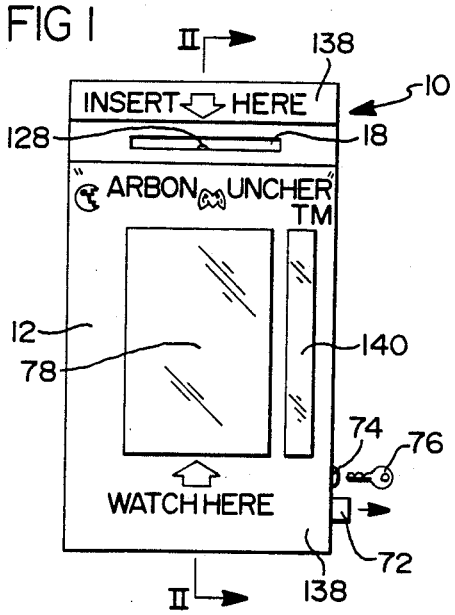
FIG. 1, is a front plan view of the document processor of the present invention.

Referring to the drawing figures, a security document processor 10 is illustrated which, in its intended application, obliterates confidential financial and account information imprinted on carbon pull out sets of multi-copy business forms typically employed at retail point of sale transactions, particularly with embossed credit cards.

Processor 10 has a generally rectangular vertically elongated housing 12 constructed of injection molded plastic or other suitable material. Downwardly directed converging ribs 14 and 16 integrally formed within the top surface 13 of housing 12 define a laterally extending slot 18 for receiving a security document such as a carbon set 20 from a credit card transaction form. Two tangentically abutting rollers 22 and 24 are carried within housing 12 with the line of contact between rollers 22 and 24 disposed directly beneath slot 18.

Figure 3:
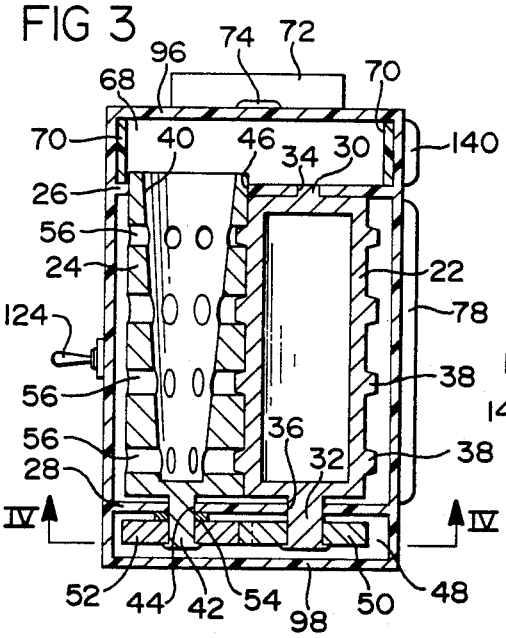
FIG. 3, is a cross sectional top view of the processor taken on lines 3—3 of FIG. 2.

As is best viewed in FIG. 3, housing 12 includes two laterally opposed partitions 26 and 28 integrally formed therewith interspacing rollers 22 and 24. Roller 22 is formed of suitable material such as injection molded plastic, is generally cylindrical in shape and includes integral end closure members with outwardly extending axles 30 and 32 extending through through bores 34 and 36 in partitions 26 and 28, respectively. Axles 30 and 32 are aligned whereby roller 22 is restrained from axial or radial transposition from its illustrated position but it is free to rotate upon its axles. An array of radially outwardly extending chisels or punches 38 are integrally formed on the outer surface of roller 22.

Roller 24 has a generally cylindrical shape with a conical inner cavity 40. The end of roller 24 associated with in minor dimension or small end of conical cavity 40 is closed by an integral end member carrying an outwardly directed axle 42 extending through a bore 44 within partition 28. The end of roller 24 associated with the major radial dimension of conical cavity 40 extends through and is radially restrained by a passageway 46 within partition 26. Axles 32 and 42 extend within a closed cavity 48 of housing 12 and carry upon a free end thereof intermeshed spur gears 50 and 52, respectively, which are affixed thereto such as by heat staking or other suitable process. A spacer bushing 54 disposed between gear 52 and partition 28 upon axle 42 restrains roller 24 axially.

Roller 24 contains an array of chisel receiving recesses or dies 56 in the outer surface thereof which are complimentary to the array of chisels 38 and roller 22. Recesses 56 extend radially inwardly from the outer surface of roller 24 to the inner surface thereof defined by cavity 40. Chisels 38 and recesses 56 form complimentary sets whereby rollers 22 and 24 are free to counter rotate about their respective axles with each recess 56 having an associated chisel 38 which is inserted therein momentarily as they pass through the line of rolling contact between rollers 22 and 24.

Although only four sets of chisels and recesses 38 and 56 are illustrated along the lateral extent of rollers 22 and 24, respectively, it is contemplated that a substantially larger number would be employed depending upon the nature of the intended document to be obliterated and the number of fields of confidential information contained thereon. Furthermore, the shape of the chisels and recesses could be varied. Although round or oval shape is preferred, diamond, square, triangle, star or other suitable shapes could be substituted. The lesser number of punch/recess sets are illustrated here for the sake of clarity.

The conical shape of cavity 40 provides a varying wall thickness of roller 24 and thus the radial length of recesses 56 will have varying characteristic lengths, the significance of which will be described hereinbelow.

Figure 4:
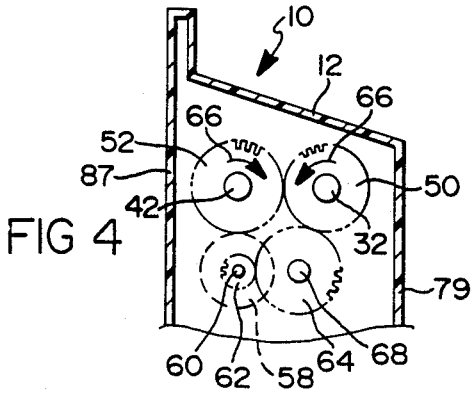
FIG. 4, is a cross sectional side view of a portion of the processor taken on lines 4—4 of FIG. 3.

As best viewed in FIG. 4, rollers 22 and 24 are driven counter rotationally by a motor 58 disposed within housing 12. Motor 58 has an output shaft 60 carrying a small drive spur gear 62. Drive gear 62 is in meshing engagement with a speed reduction spur gear 64 which, in turn, is in meshing engagement with gear 50. Gears 50 and 52 have the same number of teeth to maintain the phase relationship between rollers 22 and 24. Thus, when motor 58 is energized turning gear 62, idle gear 64 is driven and thereby drives gear set 50 and 52 causing counter rotation as indicated arrows 66. Gear 64 is axially and radially restrained by an axle 68 extending into cavity 48 from partition 28. However, gear 64 is free to turn upon axle 68.

The open end of roller 24 extends slightly through passageway 46 terminating within a cavity 68. The bottom most portion of housing 12 has an open topped drawer 70 slidedly disposed therein. Drawer 70 has a handle 72 integrally formed therewith for rightward opening as viewed in FIG. 1. A lock and key 74 and 76, respectively, are provided to ensure against unauthorized access to obliterated documents stored within drawer 70. Cavity 68 extends the entire vertical dimension of housing 14 and empties into the end of drawer 70 nearest handle 72.

Figure 2:
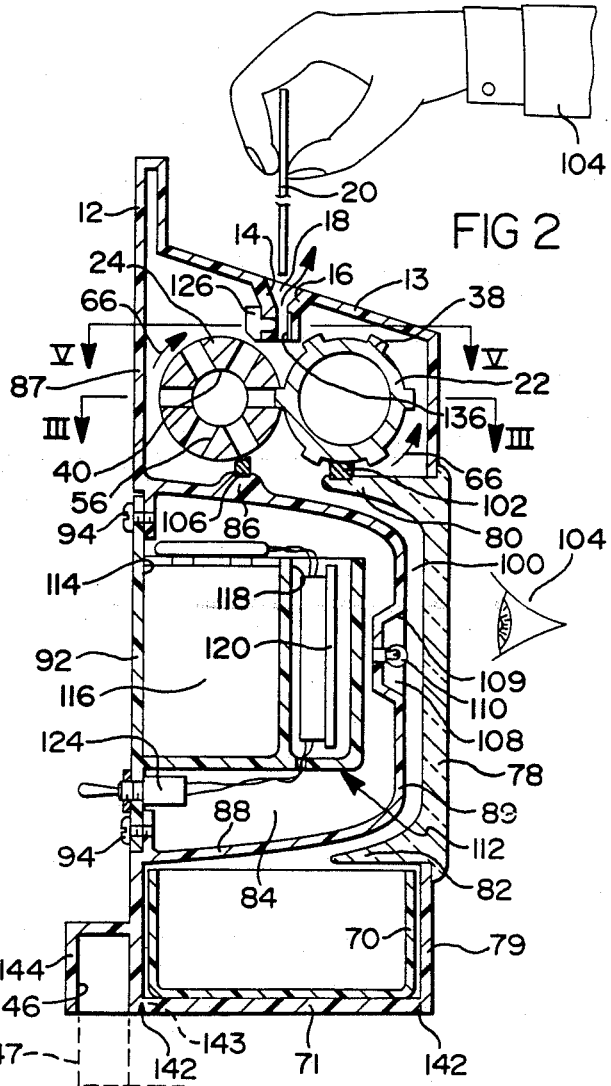
FIG. 2, is a cross sectional side view of the processor taken on lines 2—2 of FIG. 1 on an enlarged scale.

As is best viewed in FIG. 2, a generally planar viewing window 78 constructed of optically transparent material such as injection molded plastic is affixed to the front face 79 of housing 12 by adhesive ultrasonic welding or the like. The upper and lower portions of window 78 have inwardly directed guide portions 80 and 82, respectively, integrally formed therewith extending laterally between partitions 26 and 28. Housing 12 has a generally cubical shaped inner cavity 84 formed therein vertically midway between rollers 22 and 24 and drawer 70. The upper surface of cavity 84 is defined by a web member 86 extending laterally between partitions 26 and 28 and forward from back surface 87 of housing 12 to the top edge of a vertical partition 89. Likewise, a bottom web member 88 extends laterally between partitions 26 and 28 and forward from back surface 87 of housing 12 to the lower edge of vertical partition 89. The back of cavity 84 is closed by a back cover plate 92 secured to back surface 87 by suitable fastening means such as screws 94. It is contemplated that front and back surfaces 79 and 87, respectively, top and bottom 13 and 71, respectively, right and left side members 96 and 98, respectively, partitions 26 and 28, top and bottom web members 86 and 88, respectively, and vertical partition 89 are all integrally formed of a suitable opaque materials such as injection molded plastic. As an alternative, it is contemplated that the illustrated structure could be separately fabricated from a plurality of components and assembled by techniques known in the art.

A guide slot 100 is defined by the volume space between the right-hand most surface of vertical partition 89 and the left-hand most surface of window 78 as viewed in FIG. 2, as well as the lower most surface of guide portion 80 and the upper surface of top web member 86 and the upper surface of guide portion 82 and the lower surface of bottom web member 88. Guide slot 100 extends laterally between partitions 26 and 28 and extends from the point of line contact rollers 22 and 24 downwardly, emerging adjacently above the open top of drawer 70. Thus, any security document 20 passing through guide slot 100 will be positioned for clear viewing by an apparatus operator 104.

A brush 102 is affixed to the upper surface of guide portion 80 of window 78. A second brush 106 is affixed to the upper surface of top web member 86. Both brushes 102 and 106 extend laterally between partitions 26 and 28 and include soft bristles extending upwardly to contact rollers 22 and 24, respectively, to keep a security document 20 passing through housing 12 within guide slot 100.

The central portion of vertical partition 89 has a parabolically formed rightwardly opening niche 108 formed therein which is locally coated with an appropriate reflective material 109. A small incandescent light 110 is disposed in the focal point of niche 108 whereby when illuminated will flood the entire central area of guide slot 100 with light.

Figure 5:
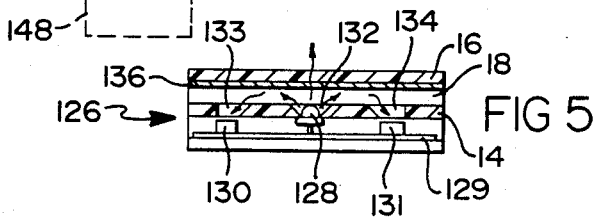
FIG. 5, is a fragmentary cross sectional top view of the optical energization switch of the document processor taken on lines 5—5 of FIG. 2.

Referring to FIG. 2, back cover plate 92 has a partition structure shown generally at 112 depending therefrom within inner cavity 84 defining a first recess 114 for nestingly receiving a dry cell battery 116 and a second recess 118 for receiving a printed circuit board 120 carrying the constituent components of a control circuit 122 shown diagramatically in FIG. 5. An off/-stand by switch 124 is mounted to back cover plate 92. Switch 124, battery 116 and light 110 are all electrically connected to control circuit 122 via suitable conductors.

Figure 6:
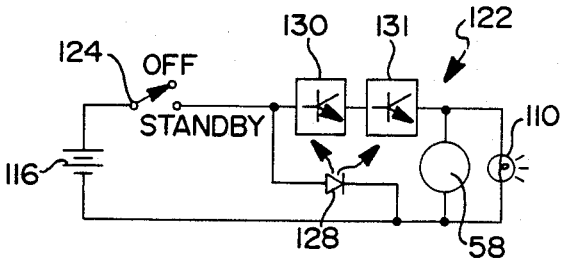
FIG. 6, is a schematic diagram of the control/drive circuit of the document processor of FIG. 1.

Referring to FIGS. 5 and 6, a multipath optical energization switch shown generally at 126 is mounted to the back surface of rib 14 and includes a light source such as a light emitting diode (LED) 128 and two photo sensitive switching devices such as photo transistors 130 and 131. LED 128 and photo transistors 130 and 131 are mounted on a suitable circuit board 129 or support member within switch 126 adjacent suitably shaped openings 132, 133 and 134, respectively, within rib 14. The left-hand surface of rib 16 has a mirror 136 mounted thereto extending laterally the entire dimension of slot 18 adjacent LED 128 and photo transistors 130 and 131. LED 128 and photo transistors 130 and 131 are electrically connected with control circuit 122 by suitable conductors. LED 128 is positioned whereby it is visible to apparatus operator 104 through document receiving slot 18 prior to the insertion of the security document 20. Electrically, control circuit 122 is arranged generally as illustrated in FIG. 6. Photo transistors 130 and 131 are arranged in series with one another and with the parallel combination of motor 58 and light 110. Photo transistors are of the type which conduct current only when they are not being illuminated by LED 128. Inasmuch as any number of circuit arrangements would be suitable for practicing the present invention, the details thereof are deleted here for the sake of brevity.

Document processor 10 operates as follows:

Prior to making a retain sale, a store proprietor would turn processor 10 from the off position to the stand by mode by actuating switch 124. When in the stand by mode, LED 128 is continuously illuminated functioning both as an "on" indicator light as well as the light source of optical energization switch 126. When a retail sale is completed, generating a security document 20 the apparatus operator 104 would take note of instruction indicia 138 contained on front surface 79 of housing 12 advising him to insert document 20 within slot 18 as illustrated in FIG. 2.

The carbon sheets of document 20 are opaque and once inserted within slot 18, will interrupt the path of travel of photons from LED 128 to photo transistors 130 and 131. Switch 126 operates by positioning LED 128 and photo transistors 130 and 131 so that they are not in direct line of sight with one another but rather are arranged whereby light emanating from LED 128 will reflect off of mirror 136 and fall upon photo transistors 130 and 131. When an opaque object such as document 20 is inserted within slot 18, the optical paths between LED 128 and photo transistors 130 and 131 are momentarily interrupted. When this occurs, circuit 122 energizes motor 58 to rotate rollers 22 and 24. Two photo transistors are illustrated and would be connected within series circuit requiring that both paths of travel be interrupted before motor 58 is energized. Although the present invention would work with a single switch, multiple light paths are provided to permit processor 10 to distinguish a security document 20 or other large plain or opaque device which is appropriate for processing from a foreign object such as a pencil, paper clip, or the like which is only large enough to block one of the light paths of a given time and thereby disable processor 10 from actuation. Whenever motor 58 is energized, light 110 is also illuminated.

As the leading edge of document 20 passes through slot 18 and approaches the line of contact between rollers 22 and 24, the rotating chisels 38 and receiving recesses 56 will capture document 20 therebetween thereby feeding document 20 at a fixed rate between the rollers. The array of chisels 38 and chisel receiving recesses 56 will serially punch an array of holes entirely through document 20 as it passes by the line of contact of rollers 22 and 24 entering guide slot 100. As the processing continues, the leading edge of document 20 will pass downwardly within guide slot 100 within the viewing range of operator 104 who at that point can verify that obliteration of the information contained on document 20 has taken place by looking through window 78. Light 110 is disposed behind document 20 to effectively backlight or back illuminate document 20 to operator 104 to highlight the obliteration process. As the trailing edge of document 20 exits slot 18, the optical path between LED 128 and photo transistors 130 and 131 will be restored and motor 58 and light 110 de-energized by circuit 122. Upon de-energization, the counter rotation of rollers 22 and 24 ceases with the portion of document 20 adjacent to the trailing edge thereof still disposed between rollers 22 and 24 with the balance of document 20 hanging downwardly within guide slot 100 in the view of operator 104. Document 20 will remain in that position until a subsequent document 20 is inserted within slot 18 at which point rotation of rollers 22 and 24 will begin again, thereby releasing the original document which will, by the force of gravity, drop downwardly through guide chute 100 into drawer 70 in a precise ordered orientation whereby drawer 70 will become filled with a vertical stack of obliterated documents 20.

As an option, circuit 122 could contain a timing circuit wherein motor 58 remains energized for a short period of time after the trailing edge of document 20 exits slot 18 and permitting the document 20 to be released by rollers 22 and 24 without the necessity of waiting for the insertion for a subsequent document. Once document 20 is inserted within processor 10, it becomes accessibly only by the person possessing key 76 and the consumer is assured not only of the document's obliteration but also that it is not accessible to unauthorized third persons.

Each pair of chisel 38 and chisel receiving recess 56 acts as a punch, generating round punch pieces or chaff from document 20 which are pressed radially within recesses 56 by associated chisels 38. Chaff will tend to accumulate within recesses 56 and remain there until urged radially inwardly by a subsequent punching operation. Thus, a particular piece of chaff will be incrementally urged radially inwardly until it emerges from recess 56 within conical cavity 40. The tapered nature of cavity 40 provides recesses 56 of differing lengths whereby a piece of chaff entering a recess 56 near the open end of roller 24 will emerge into cavity 40 long before a piece of chaff entering a recess 56 near the closed end of roller 24. This provides a timed dispersal of chaff spread over a substantial period of time involving the obliteration of a number of documents 20 to render reconstruction of the original document 20 nearly impossible.

Chaff, once free within cavity 40, will tumble therein upon rotation of roller 24. The slightly off horizontal orientation of the surface defining cavity 40 will cause chaff therein to tumble and be urged toward cavity 68 by the influence of gravity. Ultimately, chaff is discharged from cavity 40 into cavity 68 and drops directly into drawer 70 for disposition along with the obliterated original documents 20. A second vertically elongated viewing window 140 is mounted to front surface 79 of housing 12 at a lateral orientation overlying cavity 68 whereby operator 104 can also view the dispersion of chaff from roller 24 into drawer 70 through cavity 68.

As an option, notches 142 could be provided in bottom surface 71 to permit drawer 70 to be removed and bottom surface 71 knocked out to generate a hole or discharge chute 143 in the bottom 71 of housing 12 for returning the obliterated document to the customer. Furthermore, a suitable wall structure 144 integrally formed on back surface 87 of housing 12 could be provided with a downwardly opening stanchion receiving recess 146 which would permit housing 12 to be mounted upon a stanchion 147 (phantom) directly above a suitable waste container or other mechanism such as a security document imprinter 148 (phantom) for direct disposal of obliterated document 20.

It is to be understood that the invention has been described with reference to a specific embodiment to provide the features and advantages previously described and that such specific embodiments are susceptible to modification, such as will be apparent to those skilled in the art. For example, in the broadest sense a heated platen on one of the rollers and gearing to ensure dissimilar rotation rates could be used to smear the carbon and thereby obliterate the information contained on the security document. Accordingly, the foregoing is not to be construed in a limiting sense.

What is claimed is:

1. An apparatus for obliteration of confidential information imprinted upon a disposable planer portion of a multi-part security document of standard dimensions by an embossed printer at a retail point of sale, said apparatus comprising:

a generally rectangular upstanding vertically elongate housing defining a laterally extending document receiving slot in a top surface of said housing, first and second optically transparent viewing windows in a front surface of said housing, and a frangible bottom section in a bottom surface of said housing which, when removed creates a waste discharge opening, said slot dimensioned for receiving said disposable document portions, one at a time, in a predetermined orientation;

a guide member fixedly disposed within said housing means in a closely spaced generally parallel relationship with said first window, said guide member and first window coacting to define a vertically extending guide chute having an inlet at the upper end thereof and an outlet at the lower end thereof, said guide chute dimensioned whereby a document portion will freely pass therethrough in said fixed orientation generally parallel to said first viewing window;

a waste storage receptacle disposed beneath said guide chute outlet for receiving fully oblitered document portions;

a document portion processor enclosed within said housing means vertically intermediate said document receiving slot and guide chute inlet, said processor including at least two horizontally disposed tangentially abutting rollers and means operative to selectively drive said rollers counter-rotationally to engage a leading edge of a document portion inserted into said slot, to feed said document portion downwardly between said rollers, said rollers carrying a plurality of chisels and chisel receiving recesses disposed for mutual complimentary engagement to punch a predetermined pattern of holes in said document portion to serially obliterate selected confidential information imprinted on said document portion, beginning at said leading edge as said document portion passes between said rollers, and to feed said leading edge of said document portion containing said obliterated information into said guide chute inlet retaining said document portion in said fixed orientation adjacent said first viewing window whereby an apparatus operator can visually verify said information obliteration prior to said disposal of said document portion and said document portion remains entirely enclosed within said housing during said obliteration verification;

a document inlet guide disposed intermediate said document receiving slot and document processor, and a drive actuator circuit including at least one light source and at least two photo sensitive receivers laterally disposed adjacent said inlet guide on one side of said document receiving slot and an opposed reflective surface on the other side of said slot to sense the presence of an opaque object within said inlet guide and energize said drive means in response to the presence of said opaque object, said opaque object having a lateral dimension sufficient to simultaneously obstruct line of sight between said light source and both said photo sensitive receivers to energize said drive means, said light source, when illuminated, being visible to the apparatus operator;

means operative to back light said document portion as it passes before said viewing window; and guide portions depending from said guide member operative to reposition and stack oblitered documents within said storage receptacle in a second predetermined orientation and means to prevent operator access to said obliterated security documents, said storage receptacle disposed for receiving said chaff from a chaff discharge chute disposed behind said second viewing window whereby said operator can simultaneously view said obliterated document portion and chaff, said chisel receiving recesses comprising generally radially extending passageways communicating the outer circumferential surface of said roller with a single interior cavity whereby chaff punched from said document portion is progressively urged radially inwardly and discharged into said cavity for intermixing with chaff from earlier-obliterated document portions, said radially extending passageways have characteristic varying lengths to effect a time delayed discharge of said chaff into said interior cavity, said interior cavity being generally conically shaped having a closed end of minor radial diameter and an open end of major diameter, said open end communicating with said chaff discharge chute enclosed within said housing laterally adjacent said document portion discharge chute whereby upon rotation of said rollers, chaff contained within said interior cavity is simultaneously intermixed with chaff from earlier-oblitered document portions and urged toward said chaff discharge chute, and said document processor being further operative to indefinitely suspend an oblitered document portion within said guide chute in a position viewable by said operator until another security document is placed within said document receiving slot to reenergize said roller drive.

2. An apparatus for obliteration of confidential information imprinted upon a disposable planer portion of a multi-part security document of standard dimensions, said apparatus comprising:

housing means defining a document receiving slot dimensioned for receiving said disposable document portions, one at a time, in a predetermined orientation and an optically transparent viewing window on a front wall portion thereof;

a guide member fixedly disposed within said housing means in a closely spaced generally parallel relationship with said window, said guide member and window coacting to define a vertically extending guide chute having an inlet at the upper end thereof and an outlet at the lower end thereof, said guide chute dimensioned whereby a document portion will freely pass therethrough in said fixed orientation generally parallel to said viewing window;

a storage receptacle disposed beneath said guide chute outlet for receiving fully oblitered document portions; and means enclosed within said housing means operative to engage a leading edge of a document portion inserted into said slot, to feed said document portion through a processing region, to serially obliterate selected confidential information imprinted on said document portion, beginning at said leading edge as said document portion passes through said region and to feed said leading edge of said document portion containing said obliterated information into said guide chute inlet retaining said document portion in said fixed orientation adjacent said viewing window whereby an apparatus operator can visually verify said information obliteration prior to said disposal of said document portion and said document portion remains enclosed within said housing during said obliteration verification.

3. The apparatus of claim 2, wherein said housing means further comprises a frangible wall portion disposed beneath said storage receptacle, whereby upon removal of said storage receptacle and frangible wall portion, said housing means defines an obliterated document discharge slot for returning said document portion to said operator.

4. The apparatus of claim 2, wherein said storage receptacle comprises an open topped drawer for receiving document portions from said guide chute outlet.

5. The apparatus of claim 4, wherein said housing means further comprises guide portions operative to reposition and stack oblitered documents exiting said guide chute outlet within said drawer in a second predetermined orientation.

6. The apparatus of claim 5, wherein said drawer is dimensioned slightly larger than said document standard dimensions.

7. The apparatus of claim 2, further comprising function instructional indicia carried by said housing.

8. The apparatus of claim 2, wherein said housing means comprises stanchion receiving means for suspending said apparatus above a waste receptacle whereby obliterated documents discharged from said guide chute will drop by gravity into said waste receptacle.

9. The apparatus of claim 2, wherein said housing means comprises means for rigidly retaining said apparatus to an embossed card security document imprinter for use at retail point of sale transactions.

10. An apparatus for obliteration of confidential information imprinted upon a disposable planer portion of a multi-part security document of standard dimensions, said apparatus comprising:

housing means defining a document receiving slot in an upper portion thereof dimensioned for receiving said disposable document portions, one at a time, in a predetermined orientation and an optically transparent viewing window on a front wall portion thereof;

a guide member fixedly disposed within said housing means in a closely spaced generally parallel relationship with said window, said guide member and window coacting to define a vertically extending guide having an inlet at the upper end thereof and an outlet at the lower end thereof, said guide chute dimensioned whereby a document portion will freely pass therethrough in said fixed orientation generally parallel to said viewing window;

a storage receptacle enclosed in a lower portion of said housing means beneath said guide chute outlet for receiving fully obliterated document portions; and a document portion processor enclosed within said housing means vertically intermediate said document receiving slot and guide chute inlet, said processor including at least two horizontally disposed tangentially abutting rollers and means operative to selectively drive said rollers counter-rotationally to engage a leading edge of a document portion inserted into said slot, to feed said document portion downwardly between said rollers, said rollers carrying a plurality of chisels and chisel receiving recesses disposed for mutual complimentary engagement to punch a predetermined pattern of holes in said document portion to serially obliterate selected confidential information imprinted on said document portion, beginning at said leading edge as said document portion passes between said rollers, and to feed said leading edge of said document portion containing said obliterated information into said guide chute inlet retaining said document portion in said fixed orientation adjacent said viewing window whereby an apparatus operator can visually verify said information obliteration prior to said disposal of said document portion and said document portion remains enclosed within said housing said obliteration verification.

11. The apparatus of claim 10, wherein said chisel receiving recesses comprise generally radially extending passageways communicating the outer circumferential surface of said roller with an interior cavity whereby chaff punched from said document portion is progressively urged radially inwardly and discharged into said cavity for intermixing with chaff from earlierobliterated document portions.

12. The apparatus of claim 11, wherein said radially extending passageways have characteristic varying lengths to effect a time delayed discharge of said chaff into said interior cavity.

13. The apparatus of claim 12, wherein said interior cavity is generally conically shaped having a closed end of minor radial diameter and an open end of major diameter, said open end communicating with a chaff discharge chute enclosed within said housing means laterally adjacent said document portion discharge chute whereby upon rotation of said rollers, chaff contained within said interior cavity is simultaneously intermixed with chaff from earlier-oblitered document portions and urged toward said chaff discharge chute.

14. The apparatus of claim 13, wherein said housing means further defines a second optically transparent viewing window on said front wall portion adjacent said first stated viewing window whereby said apparatus operator can simultaneously view discharge of said chaff from said interior cavity into said chaff discharge chute through said second window and the leading edge of said document portion through said first stated window.

15. The apparatus of claim 13, further comprising guide portions operative to reposition and stack obliterated documents within said storage receptacle in a second predetermined orientation and means to prevent operator access to said obliterated security documents, said storage receptacle disposed for receiving said chaff from said chaff discharge chute.

16. The apparatus of claim 10, further comprising a document inlet guide disposed intermediate said document receiving slot and document processor, and a drive actuator circuit including at least one light source and at least two photo sensitive receivers laterally disposed adjacent said inlet guide to sense the presence of an opaque object within said inlet guide and energize said drive means as a function thereof, said opaque object having a lateral dimension sufficient to simultaneously obstruct line of sight between said light source and both said photo sensitive receivers to energize said drive means.

17. The apparatus of claim 16, wherein said light source, when illuminated, is visible to the apparatus operator.

18. The apparatus of claim 10, further comprising means operative to back light said document portion as it passes before said viewing window.

19. The apparatus of claim 10, wherein said document processor is further operative to indefinitely suspend and oblitered document portion within said guide chute in a position viewable by, but unaccessible to, said operator until another security document is placed within said document receiving slot to reenergize said roller drive.

* * * * *